US005404147A

United States Patent [19]

Drucker et al.

[11] Patent Number: 5,404,147

[45] Date of Patent: Apr. 4, 1995

[54] EAS SYSTEM LOOP ANTENNA HAVING THREE LOOPS OF DIFFERENT AREA

[75] Inventors: Frank Drucker, Plantation; Sylvie R. Morin; Harry E. Watkins, both of Boca Raton, all of Fla.

[73] Assignee: Sensormatic Electronics Corporation, Deerfield Beach, Fla.

[21] Appl. No.: 967,846

[22] Filed: Oct. 28, 1992

[51] Int. Cl.[6] ..... H01Q 11/12

[52] U.S. Cl. ..... 343/742; 343/741; 340/572

[58] Field of Search ..... 343/742, 866, 741, 867, 343/842; 340/571, 572; H01Q 11/12

[56] References Cited

U.S. PATENT DOCUMENTS

| | | | |
|---|---|---|---|
| 4,135,183 | 1/1979 | Heltemes | 340/572 |
| 4,243,980 | 1/1981 | Lichtblau | 340/572 |
| 4,251,808 | 2/1981 | Lichtblau | 343/842 |
| 4,260,990 | 4/1981 | Lichtblau | 343/742 |
| 4,686,513 | 8/1987 | Farrar et al. | 340/572 |
| 4,751,516 | 6/1988 | Lichtblau | 343/742 |
| 4,845,509 | 7/1989 | Asbrink | 343/867 |
| 5,061,941 | 10/1991 | Lizzi et al. | 343/742 |

FOREIGN PATENT DOCUMENTS

WO8200378 2/1982 WIPO .

*Primary Examiner*—Donald Hajec
*Assistant Examiner*—Hoanganh Le
*Attorney, Agent, or Firm*—Robin, Blecker, Daley & Driscoll

[57] ABSTRACT

An EAS system in which a transmitter alternately drives first and second antennas with the same coded message signal in its entirety. The antennas, in turn, transmit first and second signals each containing the coded message signal into respective first and second partially overlapping parts of an interrogation zone. Also disclosed is an antenna structure comprised of a plurality of loops extending one after the other and successive ones of which are of opposite phase. One of the loops circumscribes an area which is smaller than each of the other loops to realize reduced coupling to adjacent structures.

11 Claims, 2 Drawing Sheets

EAS SYSTEM LOOP ANTENNA HAVING THREE LOOPS OF DIFFERENT AREA

BACKGROUND OF THE INVENTION

This invention relates to electronic article surveillance (EAS) systems and, in particular, to apparatus for operating such systems and to antennas to be used in such systems.

U.S. Pat. No. 4,686,513, assigned to the same assignee hereof, discloses an EAS system in which a tag in an interrogation zone is subjected to coded messages which are transmitted into the zone by an antenna driven by a transmitter. These coded messages contain commands for the tag and a variety of commands can be used to invoke various actions by the tag. For example, one command may instruct the tag to transmit a coded alarm message which can be received by the antenna and coupled to a receiver. The receiver upon receipt of the alarm message can then activate an alarm to indicate that the tag is present in the zone.

The '513 patent also discloses a number of techniques for isolating the interrogation zone so that tags outside the zone are not subjected to the transmitted coded messages. One technique described is to utilize an antenna arrangement comprising two facing antennas which are turned on and off alternately and each of which transmits half of a coded message throughout the entire interrogation zone. In this way, tags within the interrogation zone receive both halves of the coded message, i.e., the entire message and, therefore, can respond accordingly. Tags outside the zone, however, only receive one or the other half of the coded message and, hence, will not respond.

While the aforesaid technique provides desirable isolation of the interrogation zone, it also requires that each antenna operate at a power level sufficient to transmit its half message over the entire zone. This power requirement is a decided disadvantage and prevents the technique from being used in many applications.

Most systems of the '513 patent type in use today employ a single antenna which transmits the entire coded message into the interrogation zone. When using such a single antenna, isolation of the zone and limiting the power used are generally realized by positioning the antenna appropriately and by limiting the size of the zone.

However, recent demands to employ the '513 patent system with interrogation zones of increased size, have spurred efforts to modify the system to meet these demands. One suggested modification has been to utilize two opposing loop antennas to simultaneously transmit the same coded message in its entirety into complementary parts of the interrogation zone. This has the advantage of limiting the power required for each antenna which also tends to limit the transmission outside the zone, including that occurring in the so-called "backfield".

With such a two loop system, in order to ensure that the entire interrogation zone is covered, a considerable degree of overlap of the zone parts covered by the transmissions from the two antennas occurs. In the overlap region, which is usually at the center of the interrogation zone, the transmissions from the two antennas tend to cancel each other. The result is a null zone which is devoid of coded message content. As can be appreciated, the presence of such a null zone is undesirable, since tags passing through the null zone will not be able to receive and respond to the transmitted messages and will go undetected.

Also, the transmissions from the proposed two loop antennas are not easily confinable to the desired zone parts and the loop antennas are themselves subject to disturbances from outside the zone. Undesired coupling of the transmissions from the loop antennas to surrounding structures such as, for example, metal conduits, support beams and door frames, additionally undesirably enlarges the field outside the zone. This is especially so for the field adjacent the lower part of the antennas, since the antennas are usually mounted in much closer proximity to the floor than to the ceiling. Finally, the proposed antennas provide a limited transmission field in the vertical direction which makes it difficult for tags positioned horizontally to respond to the antennas.

Various multiple loop, symmetrical antenna structures are known which partially compensate for some of these effects. These known antenna structures tend to compensate primarily for so-called "far field" effects, i.e., tend to enhance cancellation of antenna transmissions far from the antennas and to promote cancellation of disturbances in the antennas which originate far from the antennas (see, for example, U.S. Pat. Nos. 4,243,980, 4,260,990, 4,751,516 and 4,135,183). However, these known antennas do not also compensate for the coupling and other undesirable effects discussed above with respect to the two loop antenna system.

It is, therefore, an object of the present invention to provide an EAS system of the '513 patent type and an antenna assembly which overcome the above-discussed disadvantages.

It is also an object of the present invention to provide an EAS system of the '513 patent type and an antenna assembly in which the power requirements are lessened as compared to the '513 patent half message transmitter switching pattern, while null zones are avoided.

It is yet a further object of the present invention to provide an EAS system of the '513 patent type and an antenna assembly in which coupling of the transmitted field to adjacent structures is lessened and uniformity of the transmitted field is promoted.

It is still a further object of the present invention to provide an EAS system of the '513 patent type and an antenna assembly in which the strength of the field components in the vertical direction for the antenna transmissions is enhanced.

SUMMARY OF THE INVENTION

In accordance with the principles of the present invention, the above and other objectives are realized, in part, in an EAS system of the '513 patent type comprised of first and second antennas which are adapted to transmit signals into first and second parts, respectively, of an interrogation zone. The first and second parts of the interrogation zone together cover the entire zone and, furthermore, partially overlap.

Means is further provided for developing coded message signals and for alternately driving the first and second antennas with the entirety of the same developed coded message signal. As a result, first and second signals each containing the same coded message signal in its entirety are alternately transmitted by the first and second antennas into the first and second parts, respectively, of the interrogation zone.

In this way, the entirety of each developed coded message signal is made available in the interrogation zone, without the creation of a null zone in the overlap region between the first and second zone parts. No null zone is present, since transmission of the first and second signals into the overlap region occurs sequentially and not concurrently. Furthermore, power requirements are lessened and the interrogation zone is confined, since each antenna need only transmit into its own respective part of the zone.

In a further aspect of the invention, each transmitting antenna of the system is further adapted so as to reduce coupling of the transmitted signal or field to adjacent structures and so as to improve the uniformity and enhance the vertical field content of the transmitted signal. This is realized by utilizing an antenna having multiple loops which follow one another and which are formed so that successive loops are of opposite phase. The antenna loops are further formed such that one of the loops circumscribes an area which is less than the area circumscribed by each of the other loops. This results in reduced coupling with structures adjacent such loop.

Furthermore, a pair of adjacent loops are adapted to include first and second criss-crossed loop segments which join the adjacent loops and are at an angle relative to the horizontal to provide enhanced field components in the vertical direction. Finally, each of the loops is asymmetric relative to any horizontal line drawn through the loop so as to promote uniformity of the transmitted field.

In the embodiment of the invention to be disclosed hereinbelow, each antenna comprises first, second and third loops arranged in a common plane along the vertical direction. The second loop is situated between the first and third loops and the latter loop is situated at the bottom of the antenna and has the smallest circumscribed area. Each antenna is adapted to be situated closer to the floor than the ceiling and, hence, the presence of the smaller bottom loop reduces coupling to structures adjacent to the floor. The uppermost or first loop of each antenna is of smaller circumscribed area than the middle or second loop and the segments joining the upper or first and middle or second loops are at an inclined angle to provide enhanced field components in the vertical direction.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
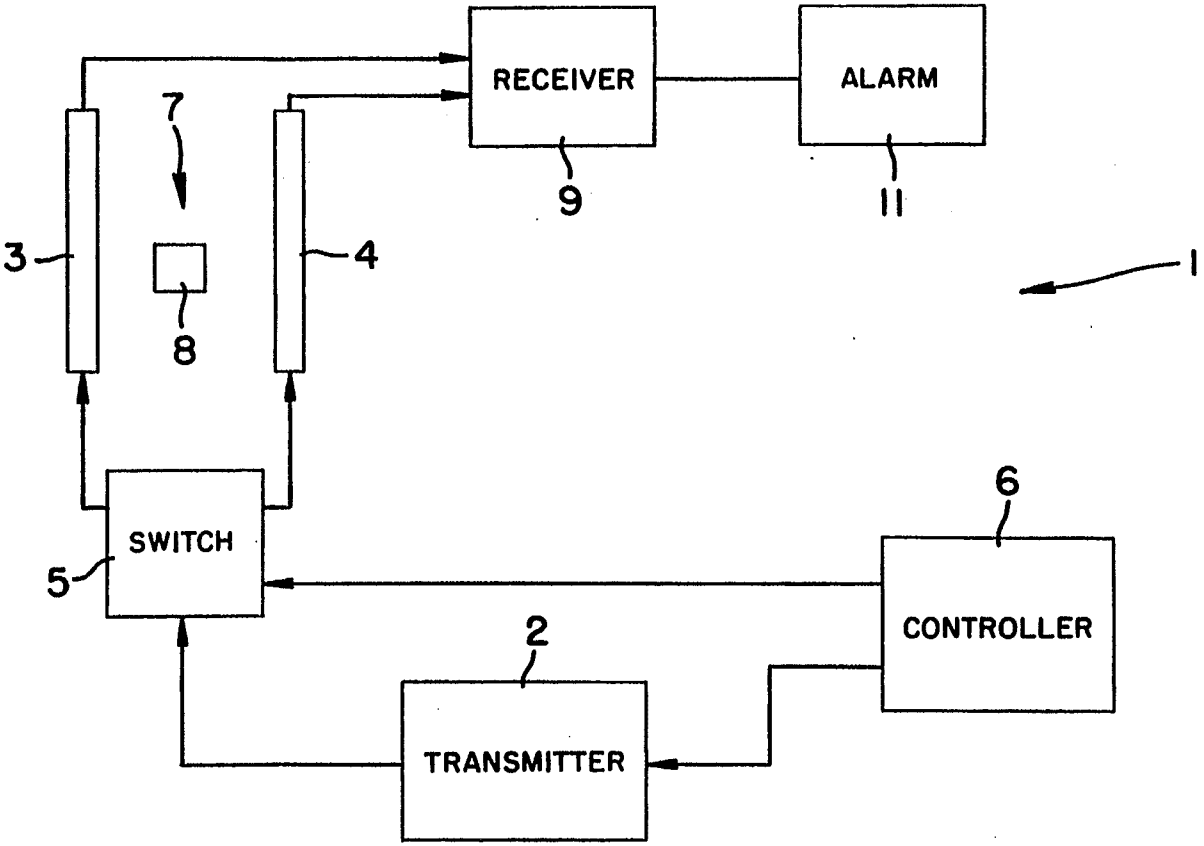
FIG. 1 shows a block diagram of an EAS system employing an antenna system in accordance with the principles of the present invention.

FIG. 1 shows an EAS system 1 of the type described in the '513 patent, the teachings of which are incorporated herein by reference. The system 1 includes a transmitter 2 which develops a coded message signal having a preamble part and a command part which together form the entire message. The coded message signal is delivered by the transmitter 2 to a switch 5 which, in turn, selectively couples the message signal to the antennas 3 and 4.

A controller 6 of the type described in the '513 patent controls the transmitter 2 and the switch 5. In controlling the transmitter 2, the controller 6 causes the transmitter 2 to generate different coded message signals corresponding to different commands to be transmitted into an interrogation zone 7 between the antennas 3 and 4.

A tag 8 of the type described in the '513 patent, when in the zone 7, receives any coded message signals transmitted therein, decodes the message signals and responds to the decoded message signals by taking the actions necessary to effect the particular commands contained in the messages. Thus, a decoded message may contain a command which requires the tag to turn on an acoustic sounder in the tag to bring attention to the tag and act as an alarm indicating that the tag is in the zone.

A coded message might also contain a command which causes the tag 8 to transmit an alarm message for receipt by the antennas 3 and 4 for coupling to a receiver 9. Upon receipt of an alarm message, the receiver 9 addresses an alarm unit 11 which alarms to again indicate presence of the tag 8 in the zone 7.

Figure 2:
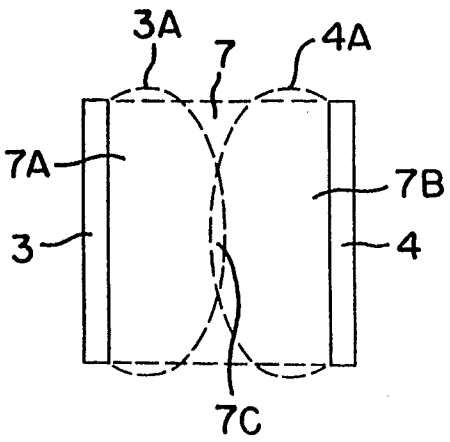
FIG. 2 shows the parts of the interrogation zone covered by the fields transmitted by the antennas of the EAS system of FIG. 1.

In accordance with the principles of the present invention, in order to limit the power level of the field or signal transmitted by each of the antennas 3 and 4, each antenna is driven so that its output field containing the coded message signal covers only a portion or part of the zone 7. However, to ensure full coverage of the zone 7, the zone parts covered by the respective antenna transmissions are such that there is a certain degree of overlap. This is depicted in FIG. 2, where the front field 3A from the antenna 3 is shown as covering the zone part 7A of the zone 7 and the front field 4A of the antenna 4 is shown as covering the zone part 7B of the zone 7. This results in an overlap region 7C, i.e, the overlap between zone parts 7A and 7B.

In further accordance with the principles of the invention, the controller 6 controls the transmitter 2 and switch 5 such that the antennas 3 and 4 are alternately driven, i.e., alternately turned on and off. Thus, when antenna 3 is being driven by the transmitter 2 or is on, the antenna 4 is not being driven or is off. Likewise, when antenna 4 is being driven or is on, the antenna 3 is not being driven or is off.

Furthermore, the controller 6 also controls the transmitter 2 such that the same coded message signal in its entirety is transmitted by the antennas in their successive driven or on states. Accordingly, with one of the antennas driven or on and the other not driven or off, a first coded message signal is transmitted by the on antenna. When the driving of the one antenna ceases and this antenna is turned off, the other antenna is then driven or turned on, and the first code message signal in its entirety is again transmitted this time by the other antenna.

As a result of this control, each encoded message signal is first transmitted in its entirety into one of the zone parts 7A or 7B of the zone 7 and, thereafter, the same encoded message signal is transmitted in its entirety into the other one of the zone parts 7A or 7B of the zone 7. The tag 8 in the zone 7 will thus be able to receive an entire coded message signal regardless of the location of the tag in the zone The above is true even if the tag 8 is located in the overlap region 7C, since the two transmissions from the antennas 3 and 4 are not present in the overlap region together and, hence, will not cancel one another. Thus, with the system of FIG. 1, by alternately operating the antennas 3 and 4 and transmitting the same entire coded message signal during the operation of each antenna, cancellation effects of the two antennas in the zone 7 are avoided. Furthermore, the system can now operate at reduced power while still covering the entire zone 7.

In a further aspect of the present invention, the antennas and 4 of the EAS system 1 are designed so as to reduce coupling of the transmitted signal or field to adjacent structures, as well as to increase the vertical field content and the uniformity of the transmitted field. This is accomplished by configuring each antenna as a multiple loop structure in which successive loops are of opposite phase and in which the loops are of different circumscribed area and asymmetrical with respect to a given axis or line (or axes or lines parallel to the given axis or line) through each loop.

Figure 3A:
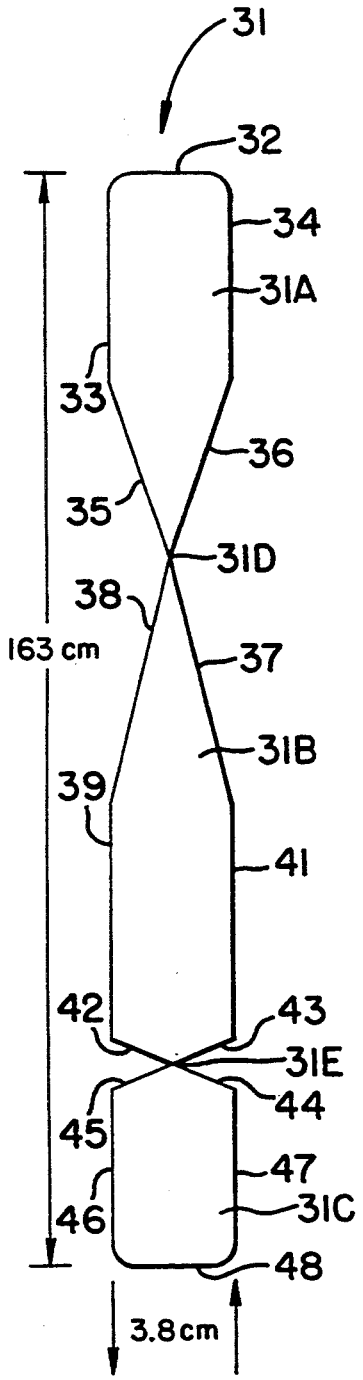
FIGS. 3A–3D show a configuration for an antenna designed in accordance with the invention and usable with the system of FIG. 1.
Figure 3B:
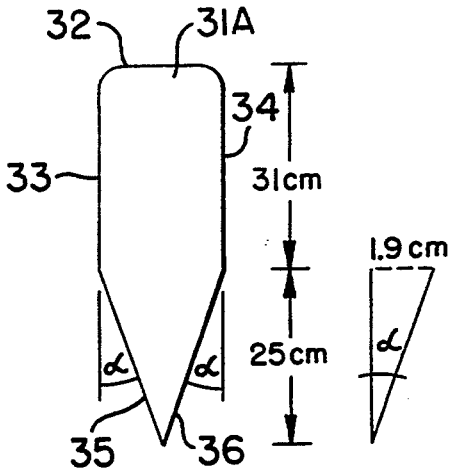
Figure 3C:
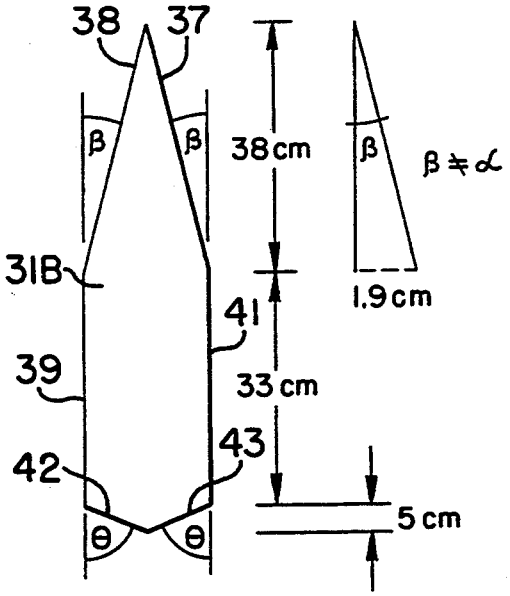
Figure 3D:
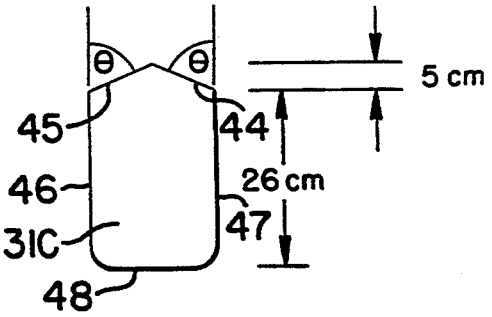

FIGS. 3A–3D shows such an antenna structure 31 which can b, used for each of the antennas 3 and 4. As illustrated, the antenna 31 comprises a continuous coil formed into three loops 31A, 31B and 31C by twisting so that successive loops are of opposite phase, i.e., 180° out-of-phase with each other. FIG. 3A shows the loops together forming the antenna. FIGS. 3B–3D, provided for explanation purposes only, show the loops individually so as to be able to indicate representative loop dimensions.

As shown, the loops 31A, 31B, 31C are in a common plane and extend in the vertical direction. The upper loop 31A includes a horizontal segment 32, two vertical segments 33 and 34 and two inclined segments 35 and 36 which extend to a first cross-over point 31D and are at an acute angle e with respect to the vertical direction. The middle loop 31B also includes two upper inclined segments 37 and 38 which continue from the inclined segments 35 and 36, respectively, but are at a different acute angle B relative to the vertical. These inclined segments are followed by two vertical segments 39 and 41 which, in turn, are followed by two further inclined segments 42 and 43 which are inclined to the vertical to a greater degree than the segments 37 and 38.

The segments 42 and 43 lead to a second cross-over point 31E. The lower loop 31C follows from the cross-over point 31E and includes inclined segments 44 and 45 which extend from the segments 42 and 43 of the middle loop 31A and are at the same acute angle e to the vertical. These segments are followed by vertical segments 46 and 47 and a horizontal segment 48 which connects the vertical segments.

With the loops 31A, 31B and 31C configured as shown, the area circumscribed by the segments of the lower loop 31C is smaller than the areas circumscribed by the segments of each of the other two loops 31A and 31B. Furthermore, the area circumscribed by the segments of the upper loop 31A is smaller than the area circumscribed by the segments of the middle loop 31B, which has the largest circumscribed area. Also, as can be appreciated, each of the loops 31A, 31B and 31C is asymmetrical with respect to a horizontal axis or horizontal line drawn anywhere across each loop.

As a result of the above configuration for the antenna 31, the antenna is found to provide a more uniform transmitted field or signal. Furthermore, the lower loop 31C is found to significantly reduce coupling to structures contained in or adjacent to the floor when the antenna is mounted close to the floor. This occurs due to the small area of the loop.

The antenna 31 is also found to result in substantial field components in the vertical direction. This is due to the relatively long inclined segments connecting the upper and middle loops 31A and 31B. It is also due to the shorter inclined segments connecting the middle and lower loops 31B and 31C.

It should also be noted that relationships between the loop segments of the illustrative antenna 31 of FIGS. 3A–3D are as follows: (a) the two segments of each of the following pairs of segments are substantially of equal length: 32,48; 33,34; 35,36; 37,38; 39,41; 42,43; 44,45; and 46, 47; (b) the acute angle $\beta$ is less than the acute angle $\alpha$ and these angles are each relatively small, i.e., less than about 45°; (c) the vertical segments 33 and 34 have lengths equal to the vertical distance covered by each of the segment pairs 45, 46 and 44, 47; (d) the vertical distance covered by each of the segment pairs 35, 37 and 36, 38 is moderately large relative to the overall length of the antenna and the segments 35 and 36 are of shorter length than the segments 38, 37; (e) the vertical distance covered by each of the segments 37 and 38 is equal to the vertical distance covered by each of the segment pairs 41, 43 and 39, 42; (f) the acute angle $\theta$ made by each of the segments 42, 43, 44 and 45 with respect to the vertical is substantially greater than $\alpha$ or $\beta$ and also less than about 45°; (g) the vertical distance covered by each of the segments 42, 43, 44 and 45 is small relative to the entire vertical length of the antenna and each segment is of substantially equal length.

It should also be noted that the antenna 31 of FIG. 3 with dimensions as shown was designed for use with interrogation zones of 3 and 6 foot widths. However, the antenna can also be used with zones of other widths as well.

Finally, the antenna 31 of FIG. 3 can be used with systems which operate other than as described above for the system 1 and can be employed alone or with an opposing antenna of the same or other configuration. Likewise, the system 1 operating as described above, need not employ antennas configured as antenna 31 but can employ other antenna configurations. Also, as disclosed, the antennas 3 and 4 of the system of FIG. 1 function as transceivers. However, the system 1 can employ separate receiver antennas and the antennas 3 and 4 are then used only as transmitting antennas.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is

1. An antenna for use with an EAS system, said antenna comprising:

first, second and third loops, said first, second and third loops being coplanar and being arranged one after the other along a common axis and such that successive loops are of opposite phase, said second loop being situated between said first and third loops;

said first loop including: a first horizontal loop segment; second and third vertical loop segments extending from opposite ends of said first loop segment; fourth and fifth loop segments, said fourth loop segment extending from said second loop segment at an acute angle of less than about 45° relative to the vertical direction and in the direction of said third loop segment, said fifth loop segment extending from said third loop segment at an acute angle of less than about 45° relative to the vertical direction and in the direction of said second loop segment, said fourth and fifth loop segments extending to a first intersection point;

said second loop including: sixth and seventh loop segments, said sixth loop segment extending from said fourth loop segment and being inclined at an acute angle of less than about 45° relative to the vertical direction and said seventh loop segment extending from said fifth loop segment and being inclined at an acute angle of less than about 45° relative to the vertical direction; eighth and ninth vertical loop segments extending from said sixth and seventh loop segments, respectively; tenth and eleventh loop segments, said tenth loop segment extending from said eighth loop segment and being inclined at an acute angle relative to the vertical direction and in the direction of said ninth loop segment, said eleventh loop segment extending from said ninth loop segment and being inclined at an acute angle relative to the vertical direction and in the direction of said eighth loop segment, said tenth and eleventh loop segments extending to a second intersection point;

said third loop including: twelfth and thirteenth loop segments, said twelfth loop segment extending from said eleventh loop segment and being inclined at an acute angle relative to the vertical direction and said thirteenth loop segment extending from said tenth loop segment and being inclined at an acute angle relative to the vertical direction; fourteenth and fifteenth loop segments extending vertically from said twelfth and thirteenth loop segments, respectively; and a sixteenth loop segment extending horizontally between said fourteenth and fifteenth loop segments.

2. An antenna in accordance with claim 1 wherein:

said third loop circumscribes an area which is less than the area circumscribed by each of said first and second loops.

3. An antenna in accordance with claim 2 wherein:

each of said first, second and third loops is asymmetric relative to a horizontal line drawn through said each loop.

4. An antenna in accordance with claim 2 wherein said first loop circumscribes an area which is less than the area circumscribed by said second loop.

5. An antenna in accordance with claim 1 wherein:

the acute angle made by each of said fourth and fifth loop segments relative to the vertical direction is at a first angle;

and the acute angle made by each of said sixth and seventh loop segments relative to the vertical direction is at a second angle different from said first angle.

6. An antenna in accordance with claim 5 wherein:

said second angle is smaller than said first angle.

7. An antenna in accordance with claim 6 wherein:

the acute angle made by each of said tenth, eleventh, twelfth and thirteenth loop segments is greater than said first angle.

8. An antenna in accordance with claim 7 wherein:

the acute angle made by each of said tenth, eleventh, twelfth and thirteenth loop segments is substantially greater than each of said first and second angles and less than about 45°.

9. An antenna in accordance with claim 1 wherein:

the vertical length covered by the fourth and sixth loop segments and the fifth and seventh loop segments is moderately large relative to the overall vertical length of said first, second and third loops.

10. An antenna in accordance with claim 9 wherein:

the vertical length covered by the eleventh and twelfth loop segments and the tenth and thirteenth loop segments is small relative to the overall vertical length of said first, second and third loops.

11. An antenna in accordance with claim 1 wherein:

said antenna is formed from a continuous cable which has been criss-crossed to define said first, second and third loops.

* * * * *

UNITED STATES PATENT AND TRADEMARK OFFICE

CERTIFICATE OF CORRECTION

PATENT NO. : 5,404,147

DATED : April 4, 1995

INVENTOR(S) : Frank Drucker et al.

It is certified that error appears in the above-indentified patent and that said Letters Patent is hereby corrected as shown below:

Col. 5, line 23. Change "b," to -- be --.

Col. 5, line 37. Change "e" to -- $\alpha$ --.

Col. 5, line 50. Change "e" to -- $\theta$ --.

Signed and Sealed this

Twentieth Day of June, 1995

*Attest:*

Bruce Lehman

BRUCE LEHMAN

*Attesting Officer*

*Commissioner of Patents and Trademarks*